US008458858B2

(12) United States Patent
Neukötter

(10) Patent No.: US 8,458,858 B2
(45) Date of Patent: Jun. 11, 2013

(54) HINGE PLATE

(75) Inventor: Hubert Neukötter, Beelen (DE)

(73) Assignee: Simonswerk, Gesellschaft mit beschränkter Haftung, Rheda-Wiedenbrück (DE)

( * ) Notice: Subject to any disclaimer, the term of this patent is extended or adjusted under 35 U.S.C. 154(b) by 1601 days.

(21) Appl. No.: 11/130,363

(22) Filed: May 16, 2005

(65) Prior Publication Data

US 2005/0273979 A1 Dec. 15, 2005

(30) Foreign Application Priority Data

May 29, 2004 (DE) ..... 10 2004 026 392

(51) Int. Cl.
*E05D 5/12* (2006.01)

(52) U.S. Cl.
USPC ..... 16/380; 16/386

(58) Field of Classification Search
USPC ..... 16/380, 386
See application file for complete search history.

(56) References Cited

U.S. PATENT DOCUMENTS

| | | | | | |
|---|---|---|---|---|---|
| 2,769,198 | A | * | 11/1956 | Foltz | 16/276 |
| 2,772,441 | A | * | 12/1956 | Riser | 16/276 |
| 2,780,830 | A | | 2/1957 | Kammerer, Jr. et al. | |
| 2,797,433 | A | * | 7/1957 | Hager, Jr. | 16/381 |
| 2,817,871 | A | * | 12/1957 | Chamberlain | 16/381 |
| 3,013,297 | A | * | 12/1961 | Chamberlain | 16/381 |
| 3,135,013 | A | * | 6/1964 | Parsons | 16/259 |
| 3,390,419 | A | * | 7/1968 | Foltz | 16/380 |
| 3,499,183 | A | * | 3/1970 | Parsons | 16/273 |
| 4,475,266 | A | * | 10/1984 | Suska | 16/273 |
| 4,675,940 | A | * | 6/1987 | Brockhaus | 16/273 |
| 5,016,949 | A | | 5/1991 | Knurr | |
| 5,463,795 | A | * | 11/1995 | Carlson et al. | 16/273 |
| 5,720,082 | A | * | 2/1998 | Rossmo | 16/244 |
| 5,930,867 | A | * | 8/1999 | Grzeskowiak | 16/244 |

FOREIGN PATENT DOCUMENTS

DE 23 56 166 5/1975

* cited by examiner

*Primary Examiner* — Jeffrey O Brien

(74) *Attorney, Agent, or Firm* — Collard & Roe, P.C.

(57) ABSTRACT

A hinge plate had a part that can be attached to a frame or a door panel. The part has two hinge rollers that are spaced apart from one another. Sleeves are disposed in the hinge rollers so as not to rotate. A pin that is inserted into the sleeves bridges the distance between the hinge rollers. The pin has a pin head as well as a connector end for attachment of a pin screw. The pin head and the head of the pin screw attached to the pin are disposed countersunk within the hinge rollers. The pin screw has a collar that is fitted into the sleeve with a wedge fit.

4 Claims, 5 Drawing Sheets

HINGE PLATE

CROSS REFERENCE TO RELATED APPLICATIONS

Applicant claims priority under 35 U.S.C. §119 of German Application No. 10 2004 026 392.2 filed May 29, 2004.

BACKGROUND OF THE INVENTION

1. Field of the Invention

The present invention relates to a hinge plate having a part that can be attached to a frame or to a door panel, which part has two hinge rollers that are spaced apart from one another, sleeves disposed in the hinge rollers so as not to rotate, and a pin that is inserted into the sleeves and bridges the distance between the hinge rollers. The pin has a pin head as well as a connector end for attachment to a pin screw. The pin head and the head of the pin screw attached to the pin are disposed countersunk within the hinge rollers. A second hinge part is mounted on the pin so as to rotate. The second hinge part can be attached to the door panel or frame and can have a hinge tab that can be inserted into a hinge accommodation and fixed in place there by wedging, for example.

2. The Prior Art

A hinge plate having the characteristics described above is known from DE 23 56 166 A1.

Hinge plates having the structure described are known from practice and are used as premises hinges for interior and exterior doors in residential buildings, public buildings, and the like. The pin screw can come loose and fall out as the result of impacts when the doors are opened and closed.

SUMMARY OF THE INVENTION

Against this background, it is an object of the present invention to provide a hinge plate in which the pin screw of the hinge plate is reliably secured in the simplest possible manner, to prevent it from falling out.

Proceeding from a hinge plate having the characteristics described initially, these and other objects are achieved, according to the invention, by a hinge plate in which the pin screw has a collar that is fitted into the sleeve with a wedge fit. The sleeve is preferably made of plastic. The pin and the pin screw may be connected with one another by means of threads. Alternatively, the pin and the pin screw can be locked into one another by means of a bayonet closure. The connector end of the pin can be configured as a journal with the pin screw having a corresponding bore or; alternatively, the connector end of the pin may have a bore into which the pin screw can be screwed. The collar of the pin screw has a cylindrical or preferably conical outer surface, whereby the diameter is sized so that the pin screw can still be connected with the connector end of the pin, and subsequently sits in the sleeve with a wedge fit. The shaft of the pin has a diameter that is slightly less than the inside diameter of the sleeves, so that the pin can be easily installed. At the pin head, or in a segment below the pin head, the pin has a rotation locking mechanism that interacts with the sleeve assigned to the pin head. The rotation locking mechanism can include one or more projections that engage into a corresponding recess of the sleeve after the pin has been installed. A segment of the pin below the pin head is also suitable as a rotation locking mechanism. The segment is designed as a multi-edge surface and has an excess dimension as compared with a cylindrical inner surface of the sleeve.

Hinge plates for exterior doors must have a pin locking mechanism that prevents the pin from being hammered out of the hinge rollers after the pin screw has been loosened. Known pin locking mechanisms are made up of a threaded pin that can be inserted into a lateral threaded bore of the hinge rollers, and engages in a ring-shaped groove of the pin. The threaded bore is disposed so that the threaded pin is inaccessible when the door is closed. With such known measures, it is accepted that the pin screw can easily be unscrewed from the hinge roller and does not make any contribution to securing the pin. The threaded pin alone must prevent the pin from being displaced in the longitudinal direction within the sleeves. In accordance with the invention, however, securing of the pin is achieved in that the threaded pin that is inserted into a lateral threaded bore of a hinge roller rests against the collar of the pin screw and secures the collar to prevent unauthorized rotation.

It is practical if the head of the pin screw has a depression for a turning tool that is sized so that the torque that can be transferred is less than the holding moment that results from the wedge fit of the pin screw and the effect of the threaded pin that rests against the collar of the pin screw. According to the invention, it is not the pin that is secured against axial displacement, but rather the pin screw that is connected to the pin and has been fitted into the sleeve with a wedge fit that is secured against unauthorized loosening. According to a preferred embodiment of the invention, the end of the threaded pin that acts on the collar of the pin screw is configured as a sharp point or ring-shaped cutter. When the threaded pin is screwed into the threaded bore, the point or cutter digs into the surface of the collar of the pin screw, thereby producing a sufficient positive lock. However, the collar may also have a ring-shaped groove into which the end of the threaded pin, which is configured as a sharp point, for example, engages.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views:

FIGS. 2*a* to 4*a* show frame parts of the hinge plate in various embodiments;

FIGS. 2*b* to 4*b* are detail drawings of the pins and pin screws for the frame parts shown in FIGS. 2*a* to 4*a*, respectively;

DETAILED DESCRIPTION OF PREFERRED EMBODIMENTS

Figure 1:
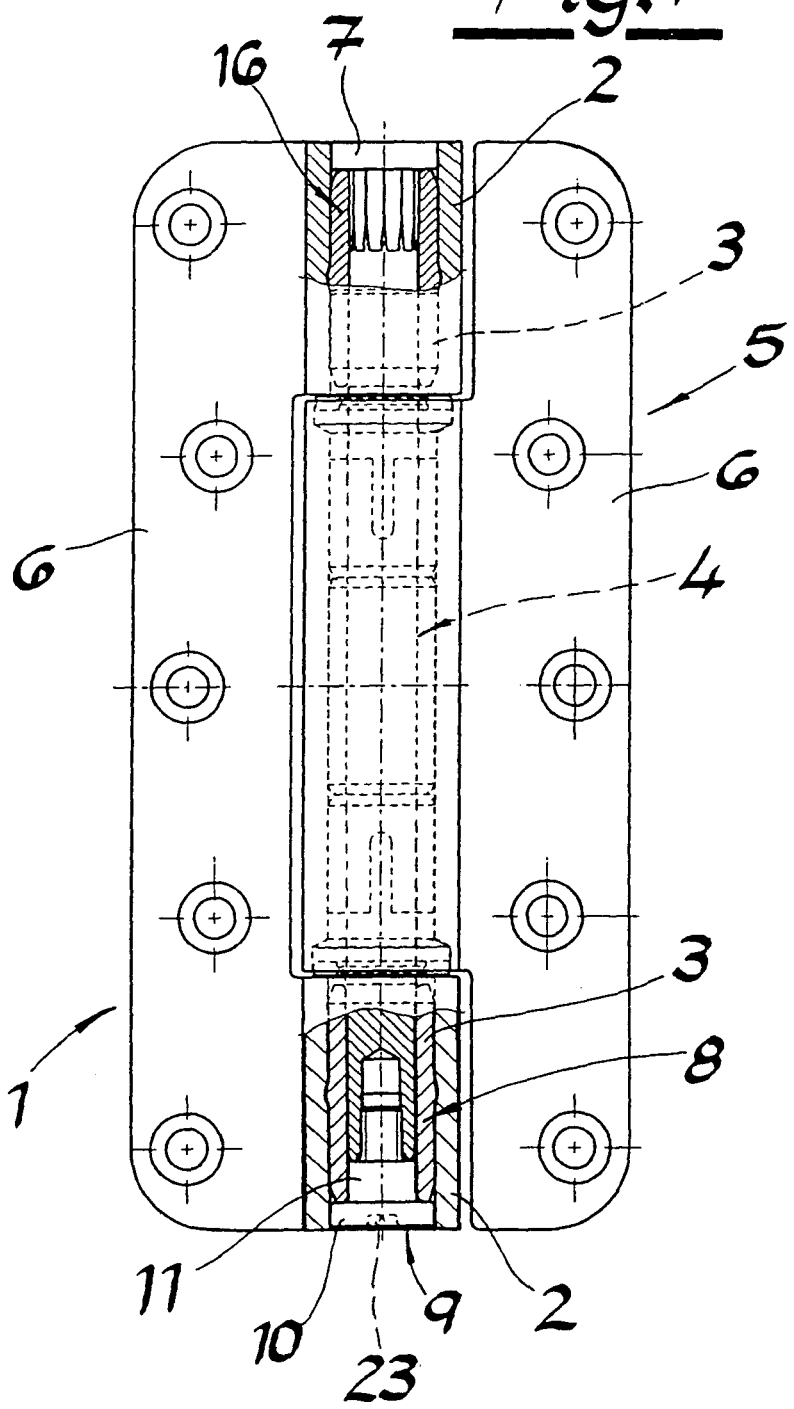
FIG. 1 shows a hinge plate.

Referring now to the drawings, the hinge plates shown are particularly intended for doors in residential buildings, public buildings, and the like. The basic structure of the hinge plate includes a part 1 that can be attached to a frame or to a door panel. Part 1 has two hinge rollers 2 that are spaced apart from one another. Sleeves 3, made of plastic, are disposed in hinge rollers 2 so as not to rotate. A pin 4 that is inserted into sleeves 3 bridges the distance between hinge rollers 2. A second part 5, which can be attached to the door panel or frame, is mounted on pin 4 so as to rotate. The tabs 6 of the two parts 1, 5 can be configured in any desired manner that corresponds to the state of the art. In the following, for the sake of simplicity, the first part 1 will be referred to as the frame part, and the second part 5 will be referred to as the door panel part. Pin 4 has a pin head 7 as well as a connector end 8 for attachment of a pin screw 9. Pin head 7 and the head 10 of pin screw 9 that is attached to the pin are disposed countersunk within hinge rollers 2.

Figure 2A:
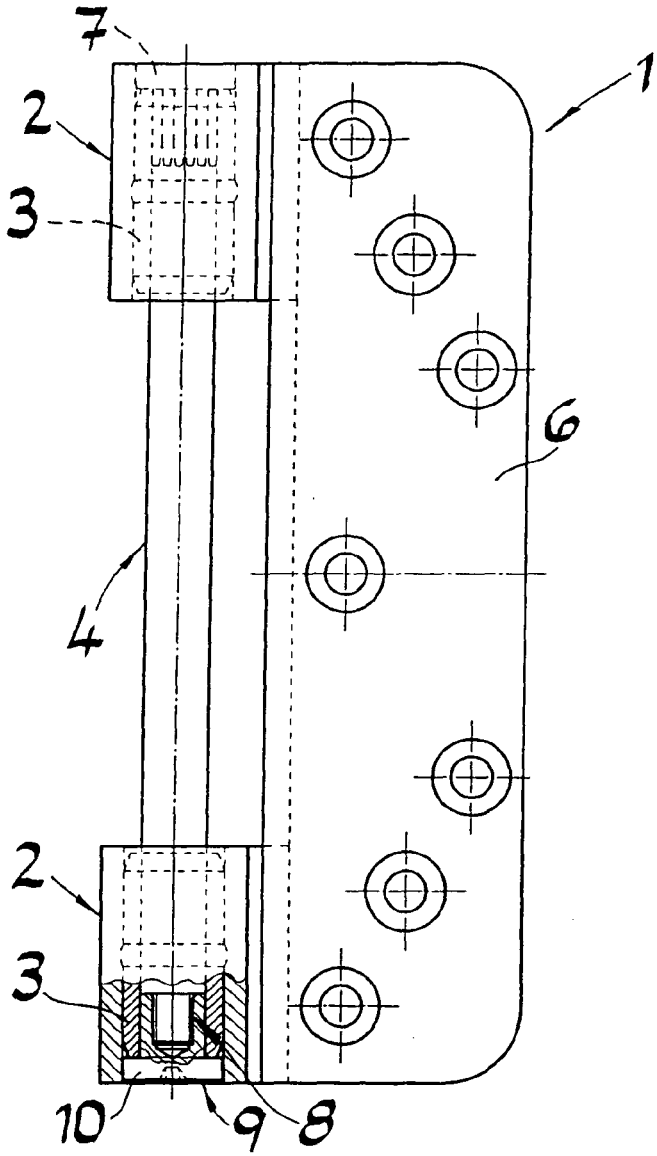
Figure 2B:
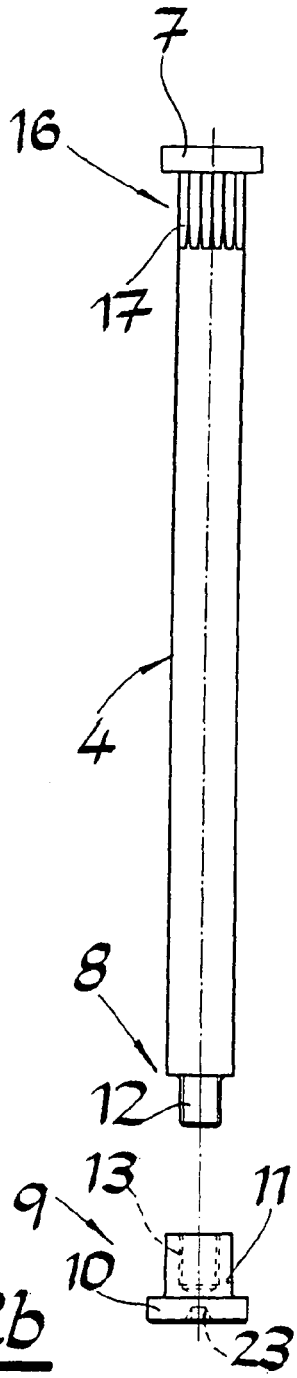
Figure 3A:
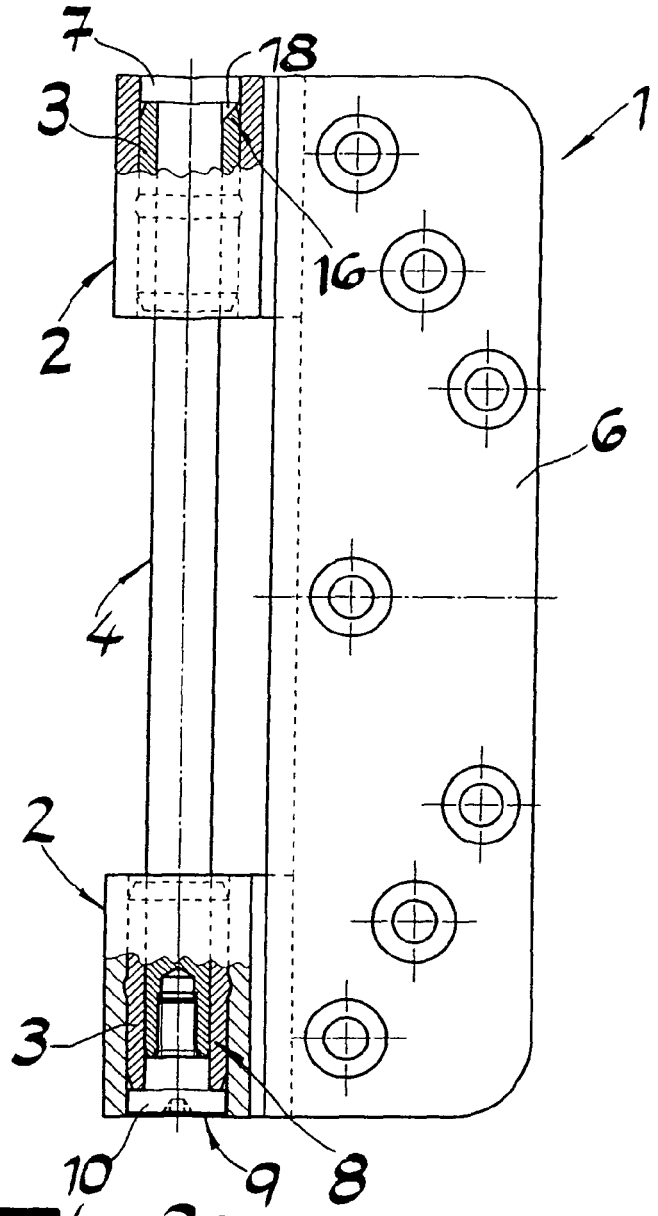
Figure 3B:
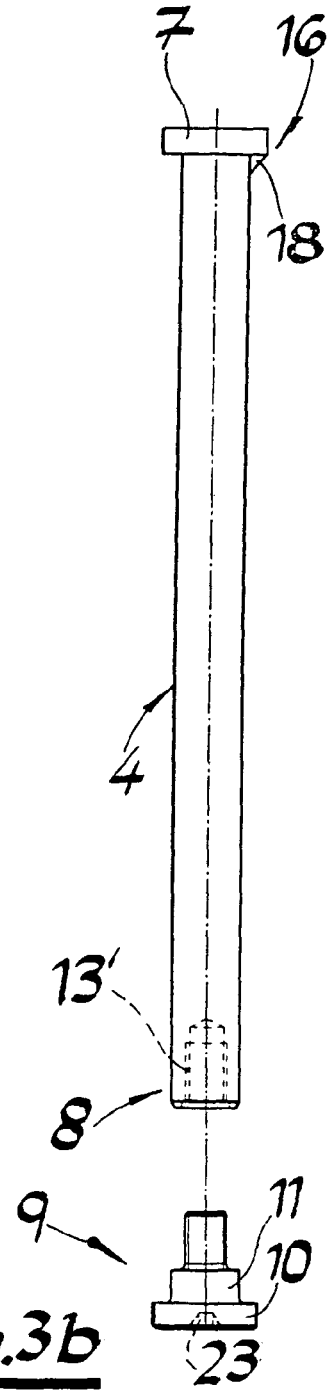
Figure 4A:
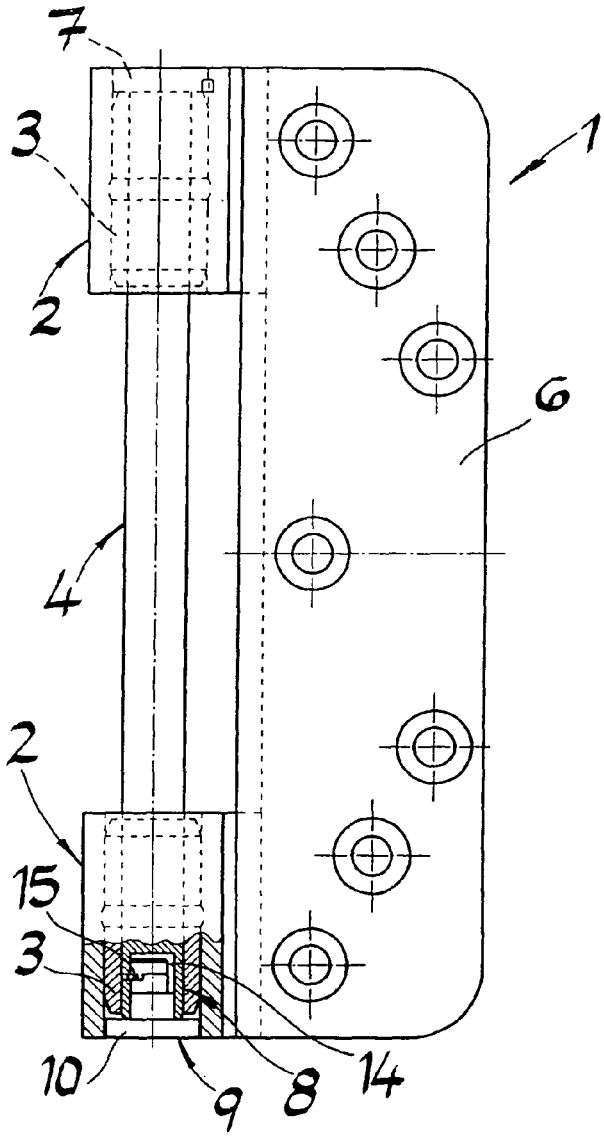

Pin screw 9 has a collar 11 that is fitted into sleeve 3 with a wedge fit. This arrangement ensures that pin screw 9 cannot come loose by itself and fall out of hinge roller 2, even in case of frequent opening and closing movements of the door. Collar 11 has a cylindrical or slightly conical outer surface and has a sufficient excess dimension for a tight fit within the sleeve, in comparison with the inside diameter of sleeve 3. Pin 4 and pin screw 9 are connected by means of a thread, or can be locked together by means of a bayonet closure. In the embodiment of FIG. 2*b*, connector end 8 of pin 4 is formed as a threaded journal 12, and pin screw 9 has a threaded bore 13 that corresponds to it. In the embodiment of FIG. 3*b*, the connector end of pin 4 has a threaded bore 13', into which pin screw 9 can be screwed. In FIG. 4*a*, a bayonet closure is provided for locking pin screw 9 and pin 4 together. At its free end, pin 4 has a journal accommodation 14, into which pin screw 9 can be inserted. In combination with FIG. 4*b*, it becomes evident that a projection 15, which projects into the journal accommodation, is formed on pin 4. An undercut is provided on the insertion journal of pin screw 9; this undercut engages behind projection 15 after a turning movement of the pin screw.

Figure 4B:
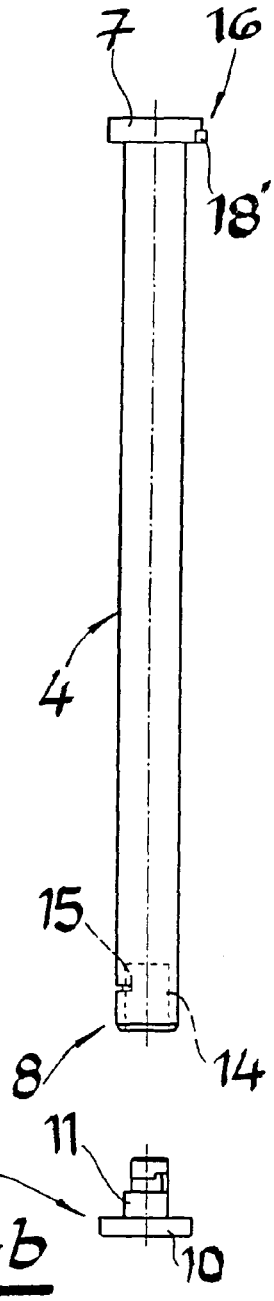

Pin 4 has a rotation locking mechanism 16 that interacts with sleeve 3 assigned to the pin head, and can be structured in different ways, as shown in FIGS. 2*b* to 4*b*. In the embodiment of FIG. 2*b*, rotation locking mechanism 16 is made up of a pin segment 17 below pin head 7, which is configured as a multi-edge surface and has an excess dimension as compared with the inside diameter of sleeve 3. In FIGS. 3*b* and 4*b*, rotation locking mechanism 16 is made up of a projection 18, 18'. This projection is disposed below the pin head or on the pin head, and engages in related recesses of sleeve 3.

Figure 5:
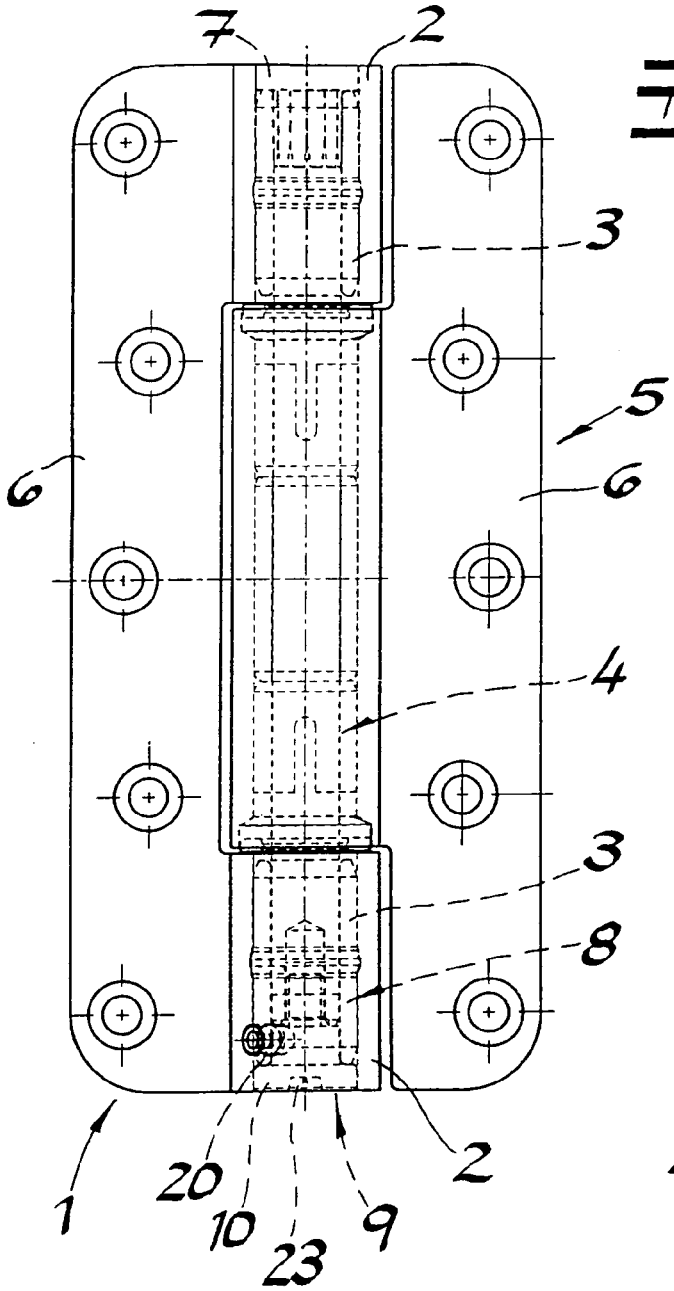
FIG. 5 shows a hinge plate having a pin locking mechanism.
Figure 6:
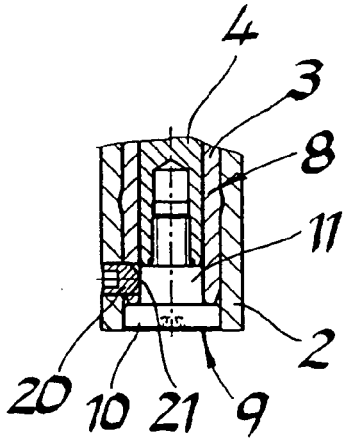
FIG. 6 is a detail of the embodiment shown in FIG. 5.
Figure 7:
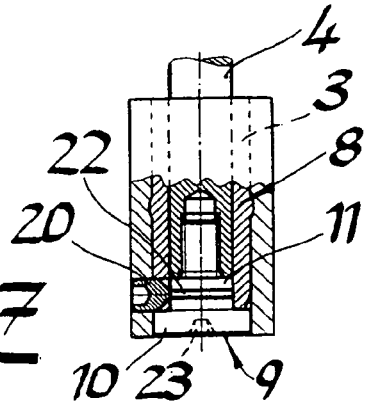
FIG. 7 shows a further embodiment of the pin screw for the hinge plate shown in FIG. 5.

The hinge plate shown in FIG. 5 has an additional pin locking mechanism, which secures pin 4 to prevent unauthorized removal. To secure the pin, one of the hinge rollers 2 has a lateral threaded bore for a threaded pin 20, which is disposed to be covered and inaccessible when the door is closed. The threaded pin 20 that is inserted into the threaded bore rests against collar 11 of pin screw 9 and secures it to prevent unauthorized turning. In the embodiment shown in FIG. 6, the end that acts on collar 11 of pin screw 9 is formed as a sharp point 21, which digs into the surface of the collar. The end of the threaded pin can also be configured as a ring-shaped cutter. In the embodiment of FIG. 7, collar 11 has a ring-shaped groove 22 into which the end of threaded pin 20 engages. In this arrangement, an even greater positive lock between the end of threaded pin 20 and collar 11 of pin screw 9 is assured. Finally, it is evident from the figures that head 10 of pin screw 9 has a depression 23 for a turning tool. This depression is sized so that the moment that can be transferred is less than the holding moment that results from the wedge fit of pin screw 9 and the effect of threaded pin 20 that rests against collar 11 of pin screw 9.

Although only a few embodiments of the present invention have been shown and described, it is to be understood that many changes and modifications may be made thereunto without departing from the spirit and scope of the invention as defined in the appended claims.

What is claimed is:

1. A hinge plate comprising:

(a) a first part for attachment to a frame or a door panel, said first part comprising first and second hinge rollers spaced by a distance from one another;

(b) first and second sleeves disposed respectively in said first and second hinge rollers so as not to rotate;

(c) a pin inserted into said sleeves, said pin bridging the distance between said hinge rollers and comprising a pin head and a connector end; and (d) a pin screw comprising a pin screw head attached to said connector end and a collar fitted into one of said sleeves with a wedge fit;

wherein said pin head and said pin screw head are countersunk within said hinge rollers;

wherein said pin and said pin screw are connected with one another by means of threads, or are locked into one another by means of a bayonet closure; and wherein said pin has a rotation locking mechanism that interacts with said first sleeve.

2. The hinge plate according to claim 1, wherein said connector end has a bore into which said pin screw is screwed.

3. The hinge plate according to claim 1, wherein said collar has a cylindrical outer surface or a conical outer surface.

4. The hinge plate according to claim 1, further comprising a threaded pin resting against said collar, wherein said pin screw head has a depression for receipt of a turning tool sized so that a torque that is transferred is less than a holding moment that results from the wedge fit of the pin screw and from the threaded pin that rests against said collar.

* * * * *